US012415637B2

(12) United States Patent
Garthaffner et al.

(10) Patent No.: US 12,415,637 B2
(45) Date of Patent: Sep. 16, 2025

(54) HIGH SPEED POUCHER

(71) Applicant: Philip Morris USA Inc., Richmond, VA (US)

(72) Inventors: Martin T. Garthaffner, Richmond, VA (US); Dwight D. Williams, Powhatan, VA (US); Jeremy J. Straight, Midlothian, VA (US); David J. Webb, Richmond, VA (US); Carl G. Miller, Richmond, VA (US)

(73) Assignee: Philip Morris USA Inc., Richmond, VA (US)

( * ) Notice: Subject to any disclaimer, the term of this patent is extended or adjusted under 35 U.S.C. 154(b) by 0 days.

(21) Appl. No.: 18/763,309

(22) Filed: Jul. 3, 2024

(65) Prior Publication Data

US 2024/0359836 A1 Oct. 31, 2024

Related U.S. Application Data

(63) Continuation of application No. 18/329,038, filed on Jun. 5, 2023, now Pat. No. 12,037,145, which is a (Continued)

(51) Int. Cl.
*B65B 1/00* (2006.01)
*B65B 1/02* (2006.01)
(Continued)

(52) U.S. Cl.
CPC ..... *B65B 1/02* (2013.01); *B65B 1/48* (2013.01); *B65B 29/00* (2013.01); *B65B 43/50* (2013.01);
(Continued)

(58) Field of Classification Search
CPC .. B65B 1/02; B65B 1/48; B65B 29/00; B65B 43/50; B65B 43/60; B65B 51/26; B65B 57/14; B65B 61/06
See application file for complete search history.

(56) References Cited

U.S. PATENT DOCUMENTS 2,113,636 A 4/1938 Vogt
2,146,308 A 2/1939 Maxfield
(Continued)

FOREIGN PATENT DOCUMENTS

DE 4111786 A1 1/1992
EP 0641524 A1 * 3/1995 ..... A24C 5/332
(Continued)

OTHER PUBLICATIONS

Notification of Transmittal of the ISR and the Written Opinion of the International Searching Authority, and copy of ISR and Written Opinion, May 9, 2012.
(Continued)

*Primary Examiner* — Eyamindae C Jallow
(74) *Attorney, Agent, or Firm* — Harness, Dickey & Pierce, P.L.C.

(57) ABSTRACT

An apparatus and methods for producing at extremely high production speeds small pouches filled with tobacco or other granular, powdered or solid content is provided. An endless web substrate, with or without flavor film thereon, is formed into a tubular shape with a longitudinal seam. The tube is cut to individual lengths, and a procession of tubes is crimp-closed at one end, filled and crimp-closed at the other end to complete pouch production. During production, the seams formed at the crimped ends of the pouch are parallel to one another and the longitudinal seam of the pouch is midway between the sides of the pouch and orthogonal to the seams formed at the crimped ends of the pouch.

20 Claims, 12 Drawing Sheets

Related U.S. Application Data continuation of application No. 17/847,683, filed on Jun. 23, 2022, now Pat. No. 11,702,232, which is a continuation of application No. 17/103,173, filed on Nov. 24, 2020, now Pat. No. 11,383,861, which is a continuation of application No. 16/022,412, filed on Jun. 28, 2018, now Pat. No. 10,870,503, which is a continuation of application No. 15/457,762, filed on Mar. 13, 2017, now Pat. No. 10,138,006, which is a continuation of application No. 13/072,681, filed on Mar. 26, 2011, now Pat. No. 9,623,988.

(60) Provisional application No. 61/317,926, filed on Mar. 26, 2010.

(51) Int. Cl.

| | |
|---|---|
| ***B65B 1/48*** | (2006.01) |
| ***B65B 29/00*** | (2006.01) |
| ***B65B 43/50*** | (2006.01) |
| ***B65B 43/60*** | (2006.01) |
| ***B65B 51/26*** | (2006.01) |
| ***B65B 57/14*** | (2006.01) |
| ***B65B 61/06*** | (2006.01) |

(52) U.S. Cl.

CPC ..... *B65B 43/60* (2013.01); *B65B 51/26* (2013.01); *B65B 57/14* (2013.01); *B65B 61/06* (2013.01)

(56) References Cited

U.S. PATENT DOCUMENTS

| | | | | |
|---|---|---|---|---|
| 2,257,823 | A | 10/1941 | Stokes | |
| 2,260,064 | A | 10/1941 | Stokes | |
| 2,292,231 | A | 8/1942 | Lesavoy | |
| 2,294,220 | A | 8/1942 | Albertson | |
| 2,325,673 | A | 7/1943 | Gurwick | |
| 2,700,855 | A | 2/1955 | Ketchpel | |
| 2,823,502 | A | 2/1958 | Adolf | |
| 2,990,081 | A | 6/1961 | De et al. | |
| 3,236,021 | A | 2/1966 | Wagner et al. | |
| 3,326,021 | A | 6/1967 | Latulippe | |
| 3,381,446 | A | 5/1968 | Marchand | |
| 3,390,039 | A | 6/1968 | Caughman et al. | |
| 3,394,870 | A | 7/1968 | Curtis | |
| 3,452,505 | A | 7/1969 | Hoag | |
| 3,606,014 | A | 9/1971 | Linn | |
| 3,735,767 | A | 5/1973 | Kruse et al. | |
| 3,750,676 | A | 8/1973 | Kruse et al. | |
| 3,879,246 | A | 4/1975 | Walker | |
| 3,987,605 | A | 10/1976 | Johnson | |
| 4,027,459 | A | 6/1977 | Nieskens et al. | |
| 4,103,596 | A | 8/1978 | Molins | |
| 4,164,438 | A | 8/1979 | Lebet | |
| 4,208,956 | A | 6/1980 | Hall | |
| 4,209,956 | A | 7/1980 | Clayson et al. | |
| 4,252,527 | A | 2/1981 | Hall | |
| 4,391,081 | A | 7/1983 | Kovacs | |
| 4,492,238 | A | 1/1985 | Wheless | |
| 4,506,779 | A | 3/1985 | Seragnoli | |
| 4,617,781 | A | 10/1986 | Ingersoll et al. | |
| 4,703,765 | A | 11/1987 | Paules et al. | |
| 4,845,922 | A | 7/1989 | Sweere | |
| 5,067,498 | A | 11/1991 | Wheless et al. | |
| 5,185,984 | A | 2/1993 | Tisma | |
| 5,221,247 | A | 6/1993 | Budjinski, II et al. | |
| 5,222,422 | A | 6/1993 | Benner, Jr. et al. | |
| 5,357,733 | A | 10/1994 | Weikert | |
| 5,442,897 | A | 8/1995 | Hinzmann et al. | |
| 5,471,820 | A | 12/1995 | Oppe et al. | |
| 5,474,092 | A | 12/1995 | Moser et al. | |
| 5,542,901 | A | 8/1996 | Atwell et al. | |
| 5,864,600 | A | 1/1999 | Gray et al. | |
| 5,875,824 | A | 3/1999 | Atwell et al. | |
| 6,212,860 | B1 | 4/2001 | Preisner et al. | |
| 6,302,113 | B1 | 10/2001 | Ozeray et al. | |
| 6,684,609 | B1 | 2/2004 | Bassissi et al. | |
| 6,918,225 | B2 | 7/2005 | Ours et al. | |
| 7,380,386 | B2 | 6/2008 | Spatafora | |
| 7,578,777 | B2 | 8/2009 | Draghetti et al. | |
| 7,674,218 | B2 | 3/2010 | Evans et al. | |
| 7,792,247 | B2 | 9/2010 | Schmied et al. | |
| 7,922,638 | B2 | 4/2011 | Draghetti et al. | |
| 7,950,399 | B2 | 5/2011 | Winterson et al. | |
| 8,118,721 | B2 | 2/2012 | Cieslikowski et al. | |
| 8,122,893 | B2 | 2/2012 | Boldrini | |
| 8,151,802 | B2 | 4/2012 | Boldrini | |
| 8,496,569 | B2 | 7/2013 | Balletti et al. | |
| 8,578,685 | B2 | 11/2013 | Fitzgerald, IV | |
| 8,757,167 | B1 * | 6/2014 | Jurczenia | B65B 51/306 83/350 |
| 9,126,704 | B2 | 9/2015 | Williams | |
| 9,820,507 | B2 | 11/2017 | Williams | |
| 10,518,921 | B1 * | 12/2019 | Duvekot | B65B 29/00 |
| 2003/0233813 | A1 | 12/2003 | Leslie et al. | |
| 2003/0234023 | A1 | 12/2003 | Dombek | |
| 2004/0102299 | A1 | 5/2004 | Meyer et al. | |
| 2005/0054501 | A1 | 3/2005 | Schroder | |
| 2007/0012328 | A1 | 1/2007 | Winterson et al. | |
| 2007/0117700 | A1 | 5/2007 | Kushihashi et al. | |
| 2007/0131233 | A1 | 6/2007 | Degliesposti et al. | |
| 2007/0261707 | A1 | 11/2007 | Winterson et al. | |
| 2008/0156337 | A1 | 7/2008 | Evans et al. | |
| 2008/0273821 | A1 | 11/2008 | Doll | |
| 2008/0313998 | A1 | 12/2008 | Ligon et al. | |
| 2009/0064638 | A1 | 3/2009 | Corbett et al. | |
| 2010/0101189 | A1 | 4/2010 | Boldrini | |
| 2011/0232232 | A1 | 9/2011 | Rinehart et al. | |
| 2011/0289887 | A1 | 12/2011 | Garthaffner et al. | |
| 2011/0303232 | A1 | 12/2011 | Williams | |
| 2012/0000164 | A1 | 1/2012 | Boldrini et al. | |
| 2012/0000165 | A1 | 1/2012 | Williams | |
| 2012/0017542 | A1 | 1/2012 | Williams et al. | |
| 2012/0028774 | A1 | 2/2012 | Ercelebi et al. | |
| 2012/0115697 | A1 | 5/2012 | Punzius et al. | |
| 2012/0252647 | A1 | 10/2012 | Pastore et al. | |
| 2013/0192168 | A1 | 8/2013 | Bracegirdle | |
| 2016/0073689 | A1 * | 3/2016 | Sebastian | D04H 1/435 156/181 |
| 2020/0115091 | A1 * | 4/2020 | Duvekot | B65B 29/00 |
| 2021/0186095 | A1 * | 6/2021 | Sebastian | B65B 9/067 |

FOREIGN PATENT DOCUMENTS

| | | | | |
|---|---|---|---|---|
| EP | 0649789 | A1 | 4/1995 | |
| EP | 1561386 | A1 | 8/2005 | |
| EP | 2145552 | A2 | 1/2010 | |
| EP | 3330191 | A1 * | 6/2018 | A24B 13/00 |
| JP | S628953 | A | 1/1987 | |
| JP | S63220786 | A | 9/1988 | |
| JP | H01215396 | A | 8/1989 | |
| JP | H0654938 | A | 3/1994 | |
| JP | 2008-538911 | A | 11/2008 | |
| JP | 2010-022370 | A | 2/2010 | |
| JP | 2013-523115 | A | 6/2013 | |
| JP | 6058308 | B2 | 1/2017 | |
| WO | 2006/106012 | A1 | 10/2006 | |
| WO | 2006/120570 | A2 | 11/2006 | |
| WO | 2008/114122 | A2 | 9/2008 | |
| WO | 2011/117751 | A2 | 9/2011 | |
| WO | WO-2011117730 | A2 * | 9/2011 | A24B 15/301 |

OTHER PUBLICATIONS

International Preliminary Report on Patentability for PCT/IB2011/001149, dated Oct. 11, 2012.

Korean Notice Of Allowance for corresponding Application No. 10-2012-7028077 dated Sep. 27, 2018, English translation thereof.

Non-Final Office Action issued Dec. 9, 2014 in U.S. Appl. No. 13/072,681.

Final Office Action issued Jun. 18, 2015 in U.S. Appl. No. 13/072,681.

(56) References Cited

OTHER PUBLICATIONS

Non-Final Office Action issued Dec. 14, 2015 in U.S. Appl. No. 13/072,681.
Final Office Action issued Jun. 3, 2016 in U.S. Appl. No. 13/072,681.
Notice of Allowance issued Dec. 12, 2016 in U.S. Appl. No. 13/072,681.
Non-Final Office Action issued Apr. 3, 2017 in U.S. Appl. No. 15/457,762.
Final Office Action issued Dec. 27, 2017 in U.S. Appl. No. 15/457,762.
Notice of Allowance issued Apr. 5, 2018 in U.S. Appl. No. 15/457,762.
Notice of Allowance issued Aug. 8, 2018 in U.S. Appl. No. 15/457,762.
Non-Final Office Action issued Mar. 27, 2020 in U.S. Appl. No. 16/022,412.
Notice of Allowance issued Jul. 31, 2020 in U.S. Appl. No. 16/022,412.

* cited by examiner

HIGH SPEED POUCHER

CROSS-REFERENCE TO RELATED APPLICATIONS

This application is a continuation of U.S. patent application Ser. No. 18/329,038, filed Jun. 5, 2023, which is a continuation of U.S. patent application Ser. No. 17/847,683, filed Jun. 23, 2022, which is a continuation of U.S. patent application Ser. No. 17/103,173, filed Nov. 24, 2020, which is a continuation of U.S. patent application Ser. No. 16/022,412, filed Jun. 28, 2018, which is a continuation of U.S. patent application Ser. No. 15/457,762, filed Mar. 13, 2017, which is a continuation of U.S. patent application Ser. No. 13/072,681, filed on Mar. 26, 2011, which claims benefit of U.S. Provisional Application No. 61/317,926, filed Mar. 26, 2010, the entire contents of each of which are incorporated herein by reference thereto.

BACKGROUND

The present application relates to methods and apparatus for producing small sealed pouches of material such as smokeless tobacco, and more particularly to such methods and apparatus that operate at extremely high speeds to produce pouches at rates of multiple thousands of units per hour.

Snus is a smokeless tobacco product sold in pouch form for adult smokers. In many instances the pouches contain tobacco and flavorants such as spearmint, peppermint or spice to name a few. The pouches are designed for placement in the mouth of the user, and the subsequent release of flavorant and tobacco liquids into the oral cavity. Individual pouches normally are sold in quantities of six or more pouches per retail package.

The production of snus filled pouches has been undertaken with pouching machines such as a MediSeal machine of MediSeal GmbH of Schloss-Holte, Germany and those which are offered by Merz Verpackungs Machinen GmbH of Lich, Germany. These machines generally operate by folding a ribbon of base web into a vertically directed tubular form, sealing along the tubular form to form a longitudinal seam as the tubular form is drawn downwardly, and transversely sealing at a location along the tube to form a first (lower) transverse seam. The web usually comprises paper. The web preferably comprises polypropylene or other suitable material to facilitate thermal sealing of the seams. Tobacco is fed into the partially formed pouch and then a second (upper) transverse seal is formed to complete the pouch structure, which is then severed from the remainder of the tubular form. This operation is repeated for each pouch, one pouch after another, and all of the aforementioned steps are executed within close proximity of each other, such that the desired orthogonal orientation of the longitudinal seam relative to the transverse seams is assured.

These machines, however, have limited production rates at or about 150 to 350 pouches per minute, because of the speed-limiting, one-at-a-time manner by which they construct, fill and complete each pouch.

In addition the drawing action utilized in the operation of those machines is prone to slippage, which causes the machine to produce pouches that vary in length and volume. Such inconsistency can impact mouth feel, taste and other attributes of the product.

The pouches are relatively small, and high speed production requires very special components that cooperate with one another in a highly beneficial manner.

The present invention is directed to machinery and the methods capable of high speed pouch production, with a capacity to maintain the desired orientation of the seams and enhanced consistency in pouch length, volume and other attributes

SUMMARY

Accordingly, one of the objects of the preferred embodiments is to provide a high speed poucher that functions to produce small sealed pouches of material such as tobacco in a highly beneficial and efficient manner.

Another object of the present invention is a poucher that produces multiple thousands of such pouches per hour.

Another object of the preferred embodiments is to provide a method of producing small sealed pouches of material such as tobacco and, optionally, flavors in a highly beneficial and efficient manner.

Still another object the of preferred embodiments is to provide a high speed poucher and method for producing small, sealed pouches of granular, powder or solid materials in a highly beneficial and efficient manner.

In accordance with one or more embodiments of the present invention, an endless supply of paper substrate is conveyed in a downstream direction, and at the same time, a separate endless supply of flavor film or strip also is conveyed in a downstream direction. The flavor strip is cut into pieces of unit length, and ultimately, each piece of flavor strip is glued in place on top of the traveling paper substrate, with equal spacing between the strips on the substrate. Glue also is applied along one edge on top of the paper.

The paper substrate with glue on one edge thereof, and with the flavor strip pieces in place thereon, is then conveyed through a garniture, where the paper substrate is formed into an endless hollow tube with the opposite edges thereof glued together, thereby forming an endless longitudinal seam. A structure within the formed tube may be used to support and maintain the tube shape. Such structure may comprise an interior brush or interior roller bar engaging the interior surface of the tube for the purpose of maintaining the structural integrity of the tube and enhancing the sealing of the longitudinal seam. Alternatively or in addition, outside vacuum may be applied to form the tube and seal the longitudinal seam.

After formation of the endless hollow tube, the tube may be cut into lengths equal to the length of each of the individual pouches being produced. The individual tubular lengths, each with a flavor strip inside, are then transferred to a series of fluted transfer drums for travel in a downstream direction. Alternatively, the tubes may be cut to a length for the production of multiple pouches, and then cut, graded and aligned downstream on the drums.

Consistent placement of the individual or multiple tubular lengths onto the first of the drums helps properly position and orient the longitudinal seam on each of the finished, formed pouches. Hence, the longitudinal seam may be located at (oriented toward) the bottom of a receiving flute or drum cavity or 180° opposite that location. This orientation ensures that subsequent crimping of the ends of the tube occurs with the longitudinal seam midway between the side edges of each formed pouch or other relative position, if desired.

A series of drums, including appropriately fluted and beveled drums, position the individual tubes in a vertical direction at the end of their path of travel from one fluted drum to the next.

Ultimately, the hollow tubes are placed on the outside flutes of a processing wheel having a vertical axis of rotation. Each tube is placed on one of the flutes of the wheel with its longitudinal seam at the bottom of the receiving flute or 180° opposite that location. A pair of crimping rollers directly below the processing wheel functions to crimp and thereby to sealingly close the lower end of each tube. Each crimping roller preferably has a vertical axis of rotation, and both axes are positioned on a radius of the processing wheel. With the longitudinal seam of each pouch positioned as explained above the lower crimping may be consistently formed, with the seam midway between the sides of each pouch being formed, if desired.

After crimping closed the lower end of each tube, rotation of the processing wheel conveys the tube to a filling station where tobacco or other content is fed into the tubes.

A second pair of crimping rollers is located above the processing wheel for crimping closed the top of each tube. The vertical axis of each of the second crimping rollers is positioned along a radius of the processing wheel, which ensures that the top crimp is parallel to the lower crimp, with the longitudinal seam midway between the sides of each pouch being formed.

The pouches then are removed from the processing wheel, inspected for quality control and packaged for transport.

BRIEF DESCRIPTION OF THE DRAWINGS

Novel features and advantages of the preferred embodiments, in addition to those noted above, will be become apparent to persons of ordinary skill in the art from a reading of the following detailed description in conjunction with the accompanying drawings, wherein similar reference characters refer to similar parts and in which.

DETAILED DESCRIPTION OF THE PREFERRED EMBODIMENTS

Figure 1:
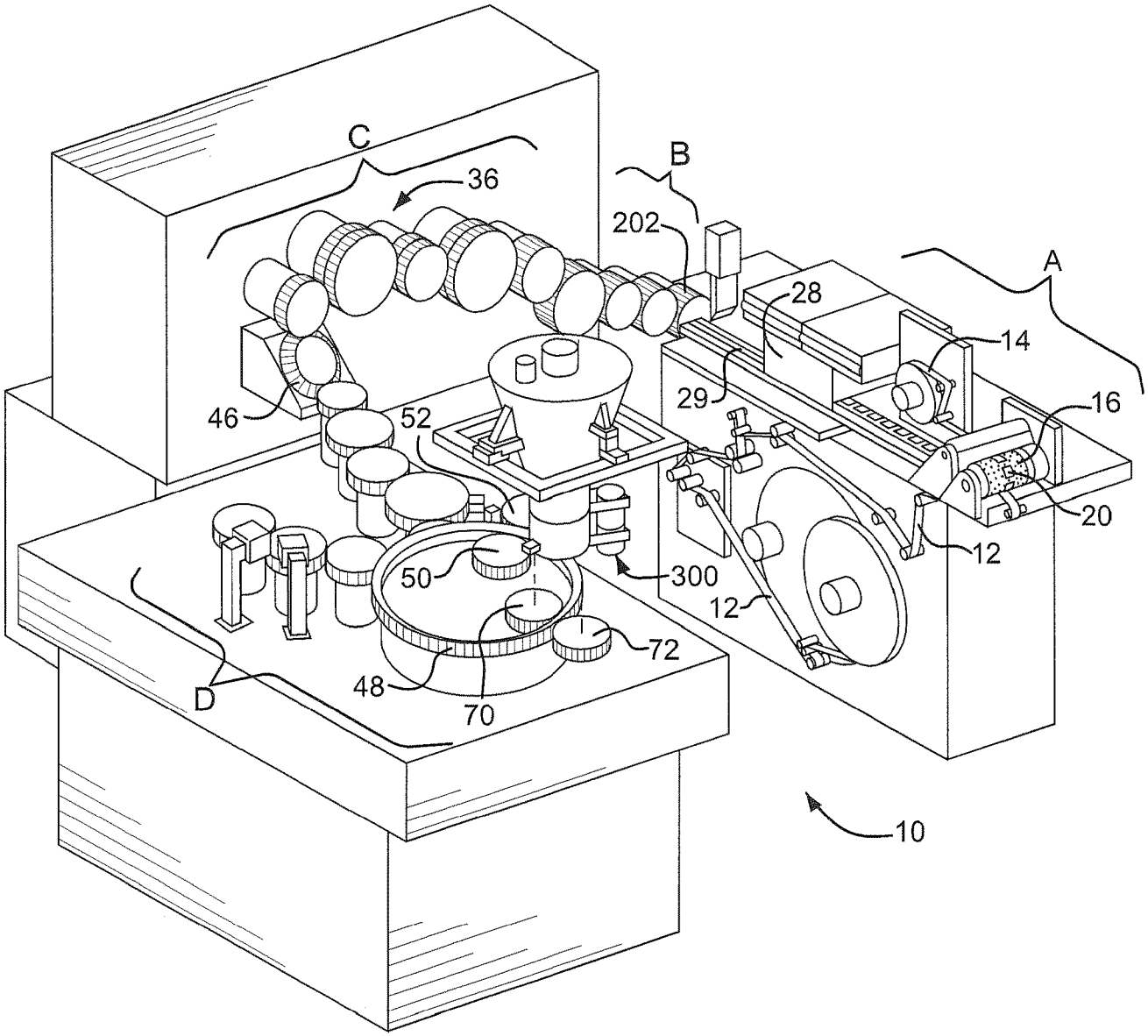
FIG. 1 is a perspective view of a high speed poucher, according to an embodiment of the present invention.

With respect to the several preferred embodiments illustrated in the drawings, a high speed poucher machine 10 is provided, which has the capacity to produce 1, 300 to 1, 700 individual pouches per minute, each pouch preferably containing a predetermined portion of tobacco and a suitable flavorant, if desired, and, optionally, a dissolvable flavor film or strip, such as that which is described in commonly assigned US published Patent Applications US 2007/0261707A1 and US 2007/0012328A1, both of which are incorporated herein by reference.

Figure 11:
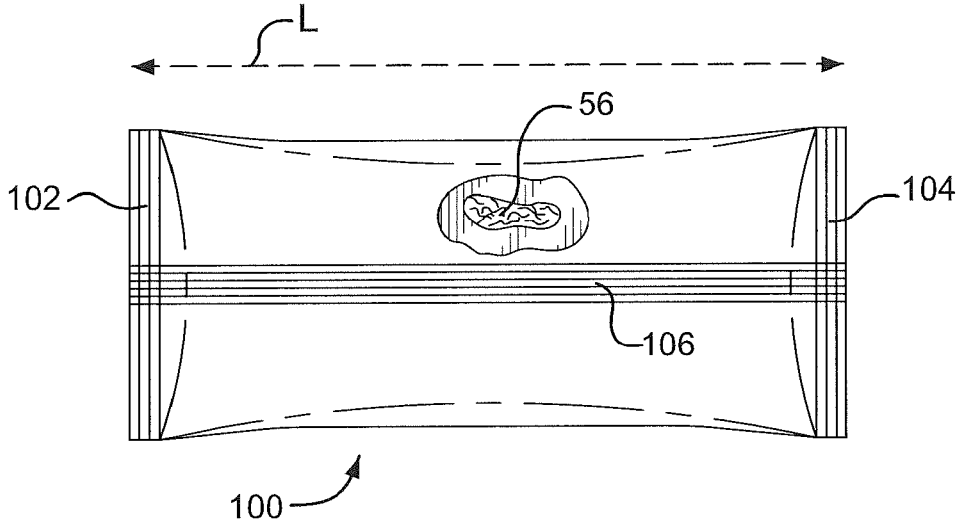
FIG. 11 is a top plan view of a finished pouch product.

Referring to FIG. 11, the product being formed in the preferred embodiments is a pouch 100 having crimped end portions that are sealed along transverse seams 102, 104 that preferably are parallel to one another. A longitudinal seam 106 extends between the crimped ends, and preferably parallel to the sides of the pouch, in an orthogonal relation to the transverse seams 102 and 104. Preferably the longitudinal seam 106 is located midway between the sides of the pouch, although its relative position could be selected to be closer to one side than the other. Each pouch 100 has a predetermined length "L".

Figure 2:
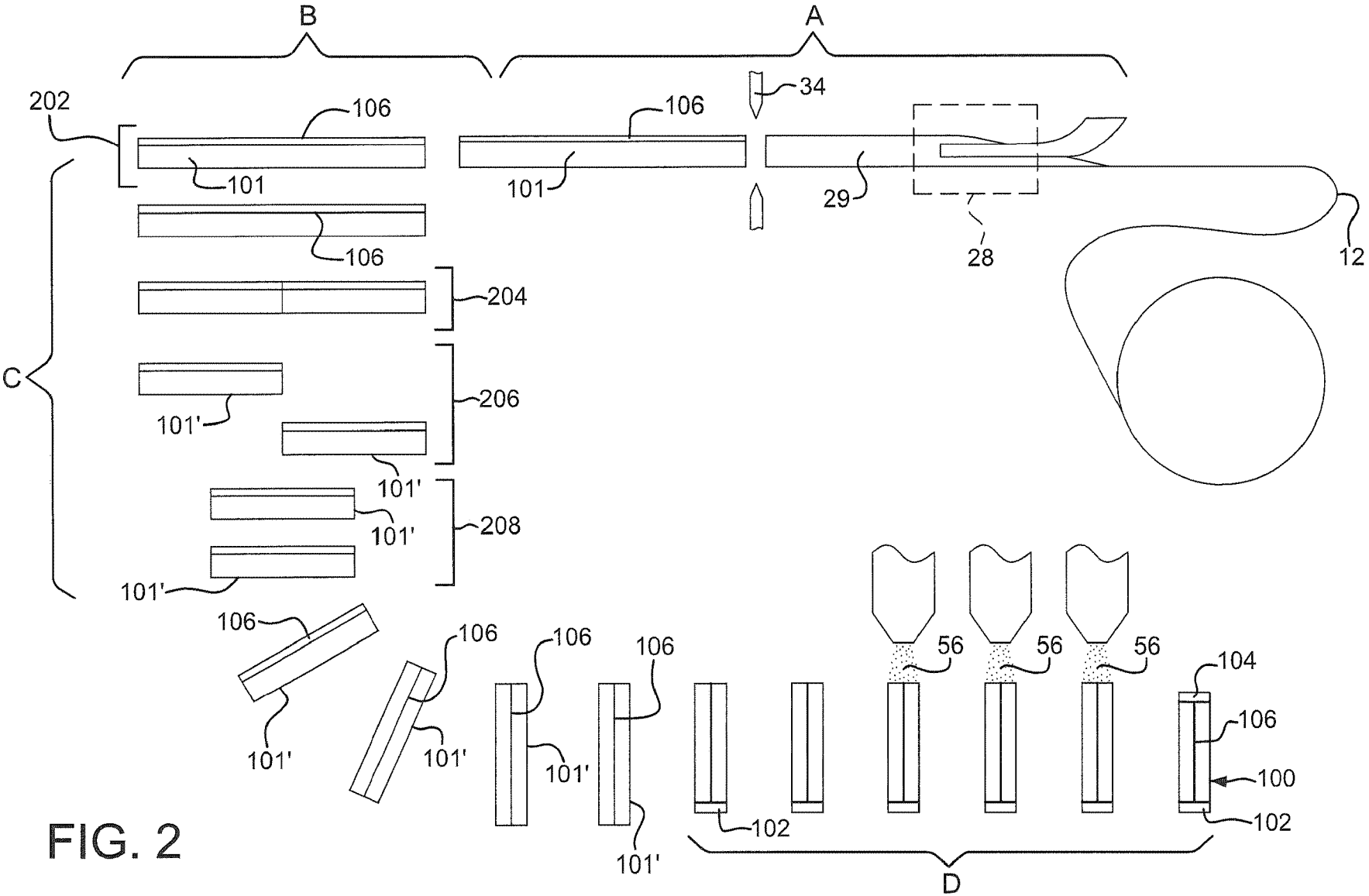
FIG. 2 is a diagrammatic view illustrating the various stages of pouch formation utilizing the poucher of FIG. 1.
Figure 9:
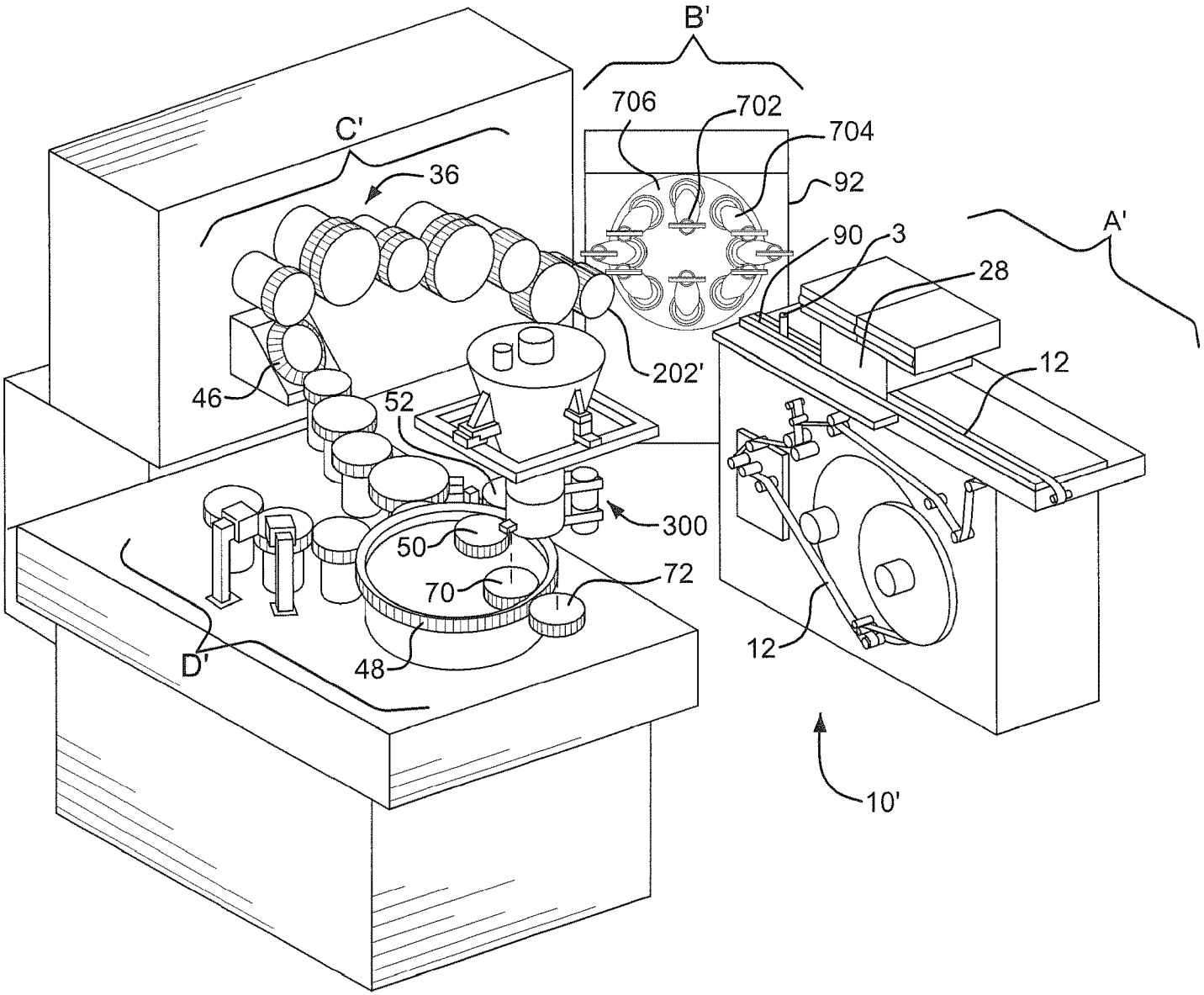
FIG. 9 is a diagrammatic view of still another embodiment of the invention similar in many respects to FIG. 1, but where pouches are produced without any flavor strip therein.

Referring to FIGS. 1, 2 and 9, there is provided embodiments of a high speed poucher machine 10, 10' capable of producing individual pouches 100 of a predetermined, unit length L. Each machine 10, 10' comprises a first section A,A', which repetitively forms open-ended, multi-unit tubular elements 101 from a continuous ribbon of base web 12, with each tubular element 101 having a longitudinal seam 106 at a given orientation and having a length preferably of a multiple of the aforementioned, predetermined unit length L; a transfer section or mechanism B,B', which transfers the output of the section A, A' onto a first drum 202 of a drum section C, C' with orientation of the aforementioned longitudinal seam 106 in a radial relation with respect to the first drum, which orientation is maintained along subsequent drums of the drum section C, C': (the drum section C, C' also cuts, grades and aligns pieces of the aforementioned tubular elements 101 into a procession of one-up tubular elements 101' of the predetermined length L); and a crimping and filling section D, D' adapted to partially close, fill and finish closing each one-up elements 101' to form a pouch 100 while the procession of one-up elements 101' are moved through the section D,D'.

Figure 10:
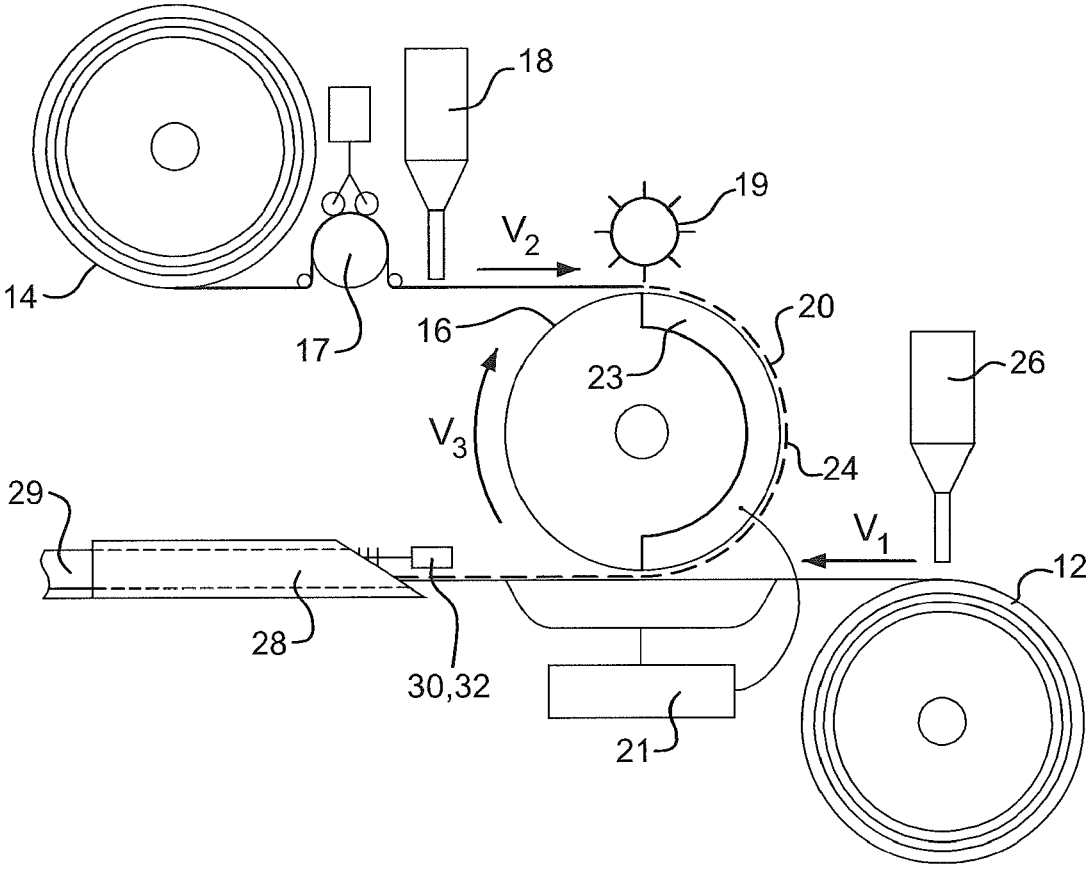
FIG. 10 is an enlarged diagrammatic view showing a portion of the machine of FIG. 1 where spaced apart flavor film or strip pieces are positioned on the endless paper substrate.

Referring now to FIGS. 1 and 10, in operation of section A, an endless supply of web 12 is conveyed in a downstream direction at a velocity V1. Web usually comprises paper, and preferably may comprise polypropylene or other suitable material to facilitate thermal sealing of the seams. At the same time, a continuous ribbon (or endless supply) of flavor film or strip) 14 is conveyed in a downstream direction at a slightly lower velocity V2, which velocity V2 is determined by the size (diameter of a metering roller 17 that is located upstream of a cork roller 16 along the path of the ribbon of flavor film 14. Glue is applied to the flavor film by applicator 18. The flavor film is fed into a nip between a knife-drum 19 and the cork drum 16 where the film 14 is cut into pieces 20 of unit length and retained on the cork drum. The cork drum has a surface velocity V3, which is equal to the velocity V1, and the differential between V2 and V3 produces a predetermined spacing 24 between the cut pieces 20 of flavor film 14 on the cork drum. The slower velocity V2 of the endless supply of flavor film and the slightly higher surface velocity of the cork drum uniquely produces the desired spacing. The spaced apart flavor strip pieces 20 then are glued or otherwise set in place on the traveling paper substrate. Preferably, glue or other adhesive 25 also is applied along one edge 27 of the paper by an applicator 26 or other suitable device. Also, vacuum 21 may be applied to a vacuum chamber 23 inside the cork drum 16 to assist in holding the cut piece 20 of flavor film to the surface of the cork drum 16. The vacuum 21 also may be supplied to the underside of the paper substrate 12 to assist in holding the pieces 20 of flavor film 14 to the top of the paper, as shown in FIG. 10.

Referring both to FIGS. 2 and 10, the paper substrate with glue along one edge 27 and with the flavor film pieces 20 in place then is conveyed through a garniture 28 where the paper substrate is formed into an continuous hollow tube 29 and the opposite edge portions of the paper are glued together forming a longitudinal seam 106 as shown in FIG. 2. The longitudinal seam 106 becomes the longitudinal seam 106, which appears in the finished pouch 100. An interior brush 30 may be used in forming and supporting the hollow paper tube, which may be omitted when a flavor film 14 is included within the tube 29. Alternatively, an interior roller bar 32 may be used for that purpose. These aspects further are described below with reference to FIGS. 3, 3A, 4 and 4A. Outside vacuum may be applied to facilitate tube formation and, in some instances, outside vacuum may be used without any interior supportive structure, particularly when a continuous flavor film 14 is combined with the web 12, which is less prone to collapse than a tubular structure comprising only the web (without any flavor film).

The formation of the continuous paper tube 29 can be executed using the endless, porous belt drive of a KDF-2 of Hauni Körber, Hamburg Germany or similar apparatus to draw the web 12 through the garniture 28. The garniture 28 has folding surfaces and glue applicators similar to those used in garnitures used in tobacco rod makers in cigarette makers, and may include ports to apply vacuum to the outside of the web being folded in the garniture to assure retention of shape.

Referring now to FIG. 2, after formation of the continuous hollow tube 29, the tube may be cut by cutter 34 into tubular elements 101 having lengths equal to the length of the individual pouch 100 (i.e., a one-up length) or, more preferably multiples thereof (i.e., two-up, four-up, six-up of length L or greater). Cutting to a one-up length might avoid the need for section C, C' and allow for section B, B' to feed directly into section D,D' of the machine 10, but a one-up element is difficult to transfer and will often tumble. It is operationally advantageous, therefore, to create at the cutter 34 tubular elements 101 of a multi-unit length and to transfer the tubular elements 101 from section A,A' of the machine 10, 10' via its section B,B'.

Once transferred, the tubular elements 101 of multiple unit lengths are moved along a series of fluted drums 36 in section C, C' in a downstream direction utilizing pocketed or fluted wheel-to-wheel, vacuum transfer technology. Preferably, there are included among the drum or wheel sections those that cut, grade and align pieces of tubular elements 101, such that at the end of the section C, C' of the machine 10, 10', there is established a procession of one-up, open-ended tubular elements 101'. For example and in reference to FIG. 2, a two-up tubular element 101 may be transferred onto the first drum 202 of section C, C', and subsequently directed through drum sections that cut (sever the workpiece into multiple pieces), grade (circumferentially displace the severed pieces with respect to one another) and align (converge the displaced pieces into a row in line with one another) as represented at the designations 204, 206 and 208, respectively. It is to be understood that a four-up tubular element would require additional repetitions of these operations, an eight-up yet more, and so forth.

Section C, C' of the embodiments of the machine 10, 10' further may include beveled drums or wheels 46, which turn the procession of one-up tubular elements 101' from a generally horizontal disposition to a generally vertical disposition conducive to the filling and crimping operations to be executed as the procession of one-up tubular elements 101' are moved through the section D,D'.

Referring back to section B,B of FIGS. 1, 2 and 9, the transfer and placement of the multi-unit length tubular elements 101 onto the first drum 202 of section C, C' is executed so that the longitudinal seam 106 ultimately is aligned radially outwardly with respect to the radius of the drum 202 at the respective receiving flute or cavity (or 180° opposite that orientation, i.e., radially inwardly). This radial relationship is maintained throughout the drum-to-drum transfers in the section C, C', and ensures that subsequent crimping and sealing of the ends of the one-up tubular elements 101' in section C,C' occurs with the transverse seams 102 and 104 in the desired orthogonal relation with respect to the longitudinal seam 106 thereof, and that the longitudinal seam 106 is positioned consistently, preferably midway between the side edges of the formed pouch 100. It is to be understood that as the tubular paper elements pass from one drum to the next, that their radial orientation alternates from radially outward to radially inward from drum to drum, which is intended to be within the meaning of "maintaining the radial relationship". Moreover, the radial relation may include a selected angle, instead of the preferred 0° and 180° radial relation discussed above.

The series of drums 36 includes a beveled drum 46 that positions the individual tubes 101' in a vertical orientation at the end of their path of travel from one drum to the next.

Referring now to FIGS. 1, 9, 13 and 14, the one-up tubular elements 101' then are directed via the last drum of section C,C' onto the outside of a continuously rotating processing wheel 48, which may have a vertical axis of rotation in section D,D' of the machine 10, 10', which placement includes maintenance of the aforementioned radial relationship of the longitudinal seam 106. As the tubes are placed on the wheel 48, a pair of crimping rollers 50, 52 directly below the processing wheel function to crimp and thereby sealingly close the lower end of each one-up tubular element 101' and form the lower, transverse seam 102. Each crimping roller preferably has a vertical axis of rotation, and both axes are positioned along a radius of the wheel. With the longitudinal seam 106 radially positioned in a flute on the wheel 48, the lower crimp 102 is formed with the longitudinal seam 106 midway between the sides of the pouch being formed, and with the desired orthogonal relationship. Other closure and sealing mechanisms might be utilized in lieu of, or in cooperation with, the crimping rollers.

After crimp-closing the lower end of the tube, continued rotation of the processing wheel 48 conveys the partially closed, one-up tubular elements 101' through to a filling station 300, where tobacco 56 or other content is fed into the tubular elements 101'. Preferably, a hopper 58 and vibratory pan feeder 60 function to perform the tobacco or other content filling operation. Content feeding and filling apparatuses also are described in commonly assigned U.S. Pat. Nos. 5,221,247 and 5,542,901, both of which are incorporated by reference in their entireties. A filling method and apparatus is disclosed in commonly assigned U.S. Pat. No. 5,875,824, which is incorporated by reference in its entirety.

Figure 15:
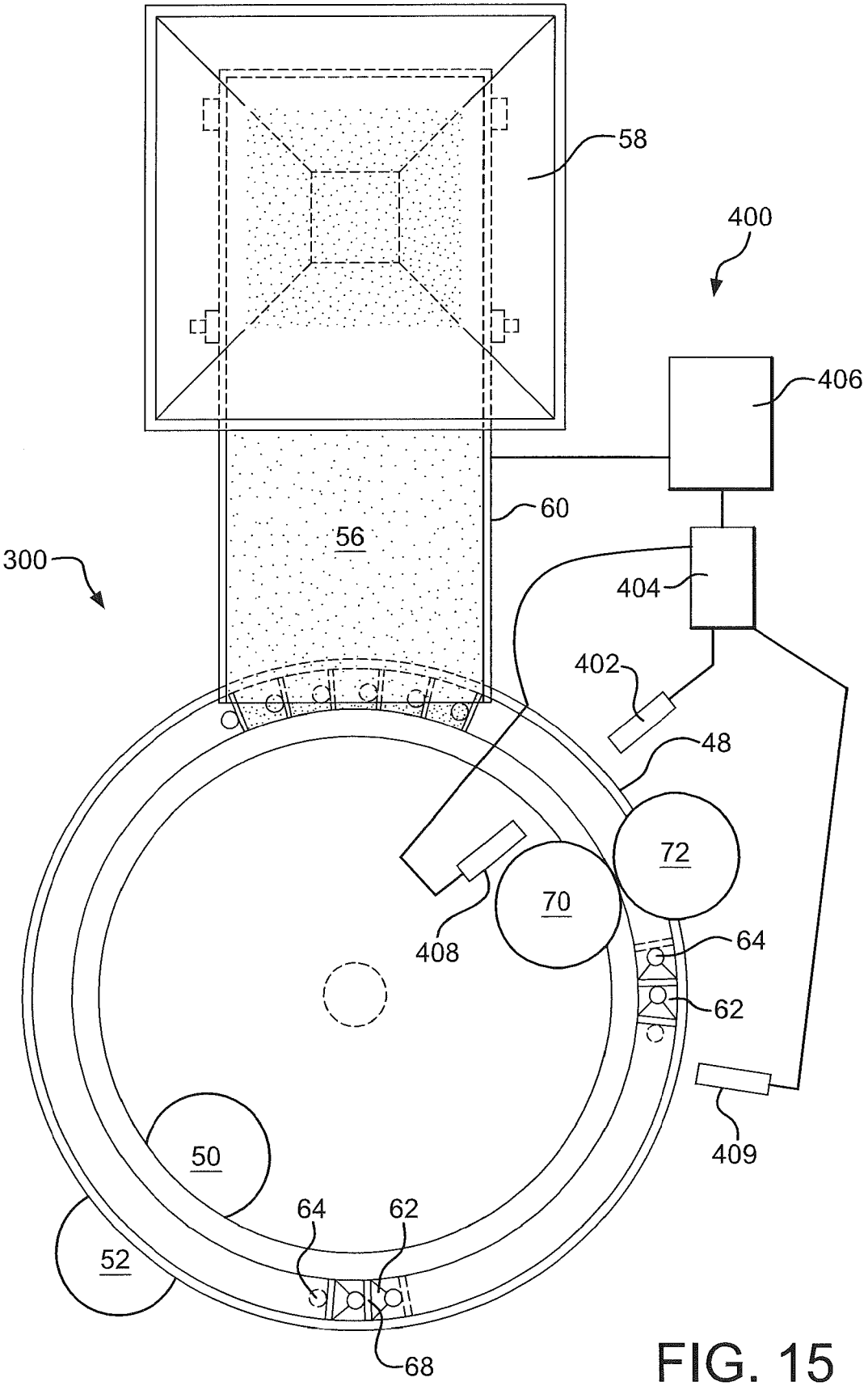
FIG. 15 is a top plan view of the hopper and vibrating pan feeder of FIG. 14.
Figure 16:
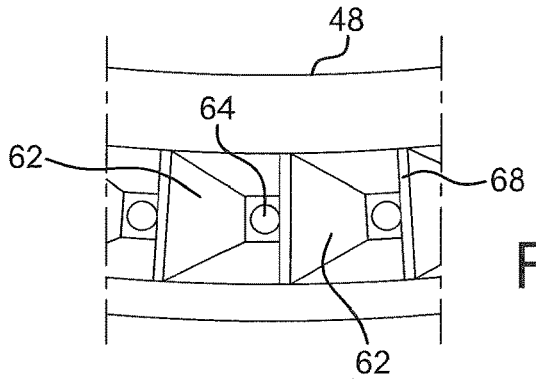
FIGS. 16-18 illustrate various side, top and sectional views of the structure for channeling the tobacco into the tubes crimp-closed at the lower ends.
Figure 17:
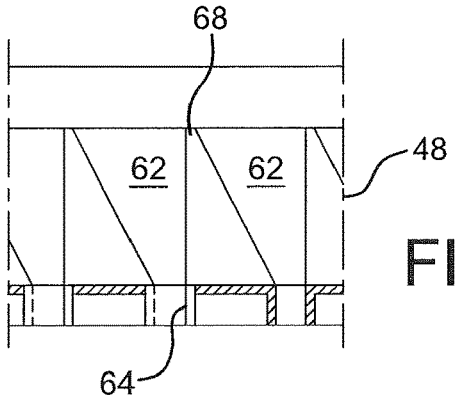
Figure 18:
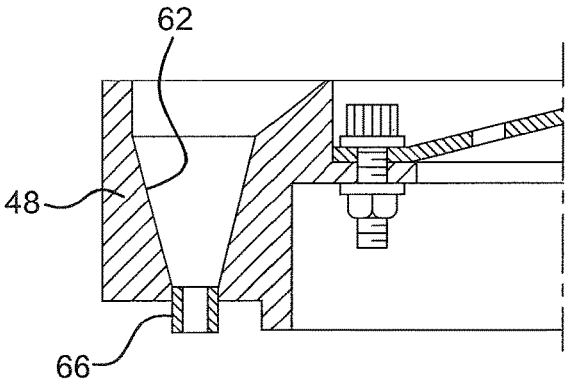
Figure 19:
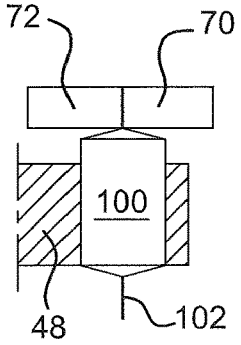
FIG. 19 is diagrammatic view with portions in sections illustrating the upper crimping rollers for sealingly closing the upper end of each tube after filling with tobacco.

Referring now to FIGS. 15 and 19, next, a second pair of crimping rollers 70, 72 spaced above the processing wheel 48 functions to crimp and seal the upper end portion or top of each one-up tubular element 101' to form the upper transverse seam 104. The vertical axes of both crimping rollers preferably are positioned (mutually aligned) along a radius of the processing wheel, to ensure thereby that the top seam 104 is parallel to the lower seam 102 and the longitudinal seam 106 is midway between the sides.

Referring now to FIG. 15, preferably, the filling station 300 includes an inspection and feed control system 400 comprising a sensor 402 at a location along the path of the procession of one-up tubular elements 101' intermediate of where delivery of content (e.g., tobacco) is completed and the top crimping rollers 70, 72, a processor 404, a feed-rate controller 406 and a rejection station 408. The sensor 402 is adapted to generate a signal indicative of the level of content in each (or a representative number) of filled tubular elements 101' as they progress toward the top crimping rollers 70, 72. The feed rate controller 406 is operative to adjust the vibration and/or the depth of tobacco 56 on the vibrating pan 60, either to elevate or to diminish delivery rate of the content responsive to signals generated by the sensor 402. The processor 404 is programmed to process and communicate signals among the operative elements of the system (the sensor 402, the feed rate controller 406 and the rejection station 408). This system 400 is operative such that should the level or volume of pouch content (or filled volume) trend away from a predetermined value (away from a product specification loaded into the processor 406), the processor 404 will adjust operation of the feed rate controller 406 responsively and counteractively to the detected trend, so that filling operations may be precisely maintained in real time and on-line. Should an intermittent or other event cause a gross departure from the specified fill volume or level, the processor may be programmed to operate the rejection station 408 to remove the out-of-specification product from the processing wheel 48. The rejection station 408 may include a controllable air jet, which directs a pulse of air radially outwardly with respect to the wheel 48 having sufficient force to overcome the vacuum retention at the flute of the wheel 48 holding the rejectable product. Mechanical pins or other expedients may be used in lieu or addition thereof in the rejection station 408.

Preferably the rejection station 408 is located upstream of (before) the top crimping rollers 70, 72 such that the rejected product is, and remains, open-ended to facilitate both the inspection and recovery of content. Recovered content can be returned to the hopper 58, thereby avoiding waste and minimizing processing steps in the recovery of content.

Optionally, the rejection station 408 may be located downstream of the top crimping rollers 70, 72 such that the rejection of product is executed with fully closed (completed) pouches 100, and content is not allowed to scatter and impact cleanliness of the filling operations. This approach may be preferred if the content is particularly fine or otherwise prone to scatter.

The inspection and control system preferably further comprises one or more final inspection stations or sensors 409 located along the pathway of the procession of completed pouches 100 while they continue movement on the processing wheel 48 or subsequent wheels (drums), so that inspection can be executed in an orderly and complete manner. For example, it is advantageous to execute a machine vision inspection of each of the finished pouches (or a selected number of them) as they move downstream of the top crimping rollers 70, 72 while they remain on the wheel 48. Such arrangement presents the longitudinal and transverse seams 106, 104 and 102 to the sensor 409 for such inspection, repetitively and in an orderly, consistent manner, to facilitate such inspection. To make the inspection complete, it is contemplated that the completed pouches 100 are transferred to another drum having another inspection station or sensor 409', where the other side of the completed pouches 100 is presented for inspection.

Once the aforementioned processes have been completed, the pouches 100 are removed from the processing wheel 48 or a subsequent wheel, optionally inspected further for quality control, and packaged. Each finished pouch preferably contains a predetermined portion of tobacco and, optionally, a flavor film. The machine 10, 10' is capable of making and filling pouches with other forms of content, not just tobacco, such as granular, powder or solid content, for example.

Continuing, FIGS. 1 and 2 illustrate one of the preferred embodiments of the present invention comprising the high speed poucher 10. Fundamentally, the poucher 10 has four sections comprising the tube formation section A, the tube transfer section B, the tube cutting, grading and aligning section C and the tube crimping, filling and closing section D.

Figure 12:
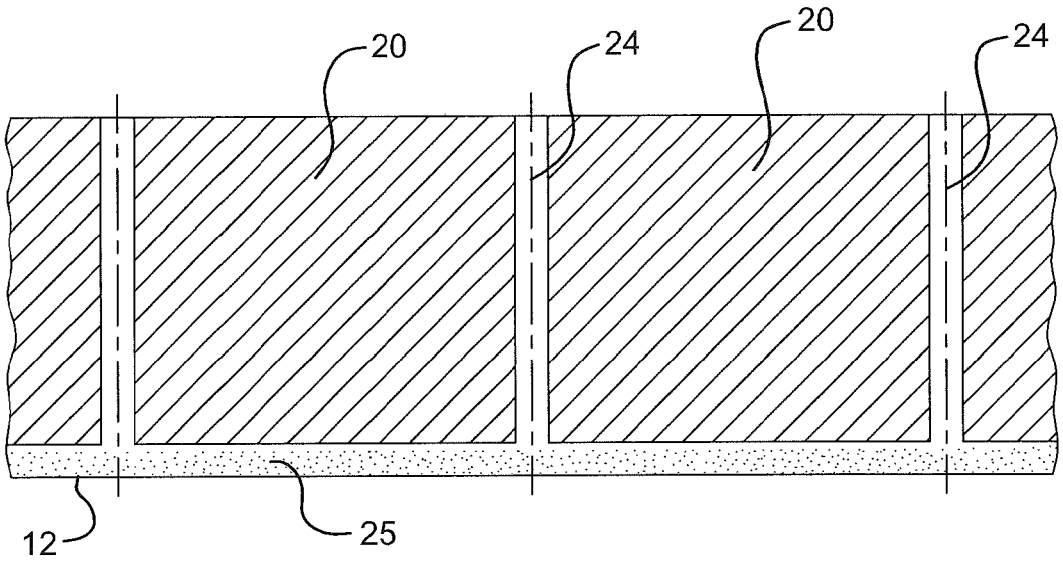
FIG. 12 is a top plan view of the endless paper substrate with spaced apart flavor film or strip pieces on the substrate.
Figures 13, 14:
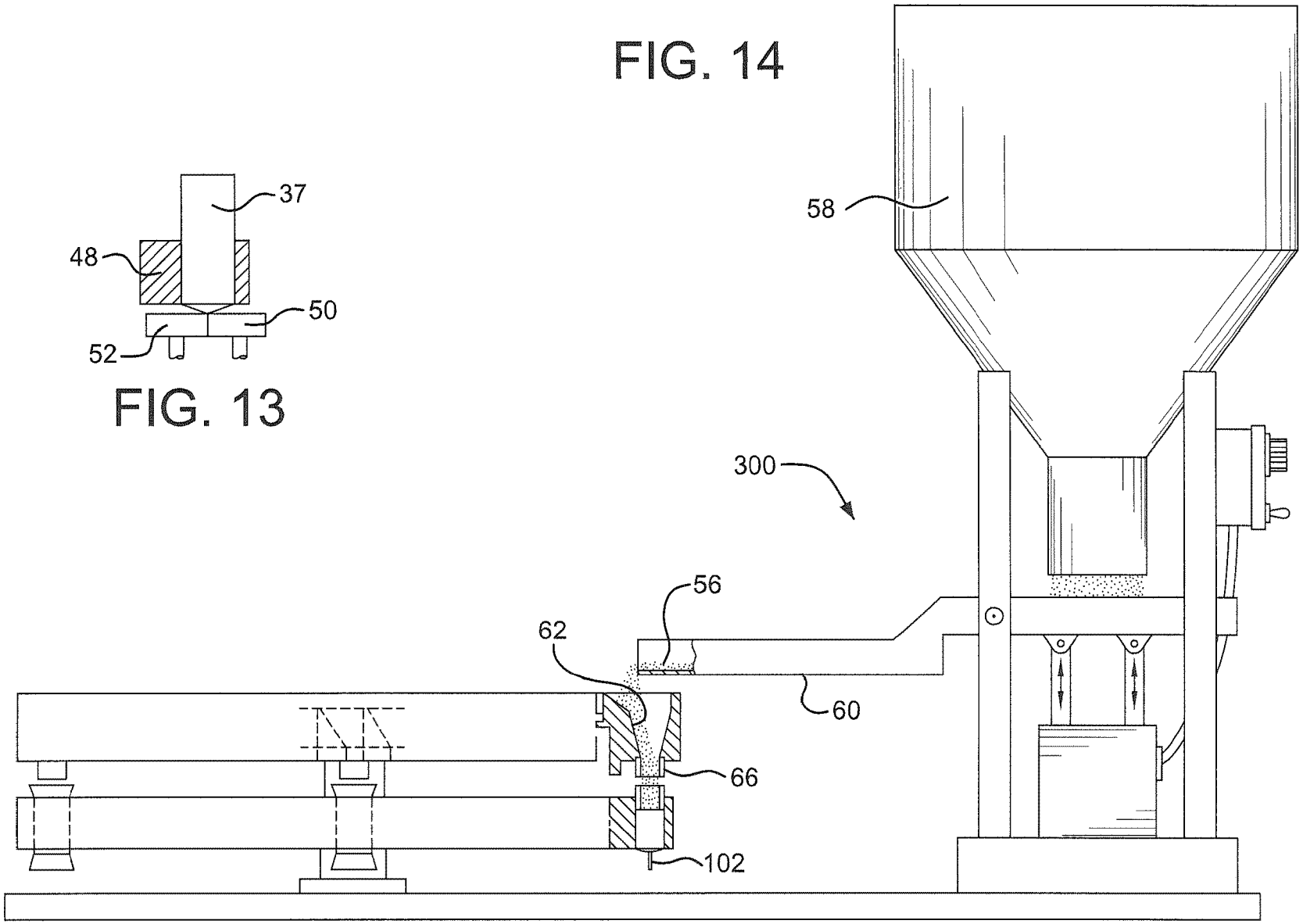
FIG. 13 is a diagrammatic view with portions in section illustrating the lower crimping rollers for sealingly closing the lower end of each formed tube prior to filling with tobacco.
FIG. 14 is a side elevational view of a hopper and vibrating pan feeder for filling the tubes with tobacco.

As shown in detail in FIG. 10, in a first embodiment, the tube formation section A includes an endless supply of paper substrate 12 conveyed in a downstream direction by suitable conveyor means (not shown) at a representative velocity V1. At the same time, an endless supply of flavor film or strip 14 also is conveyed in a downstream direction by a driven cork faced drum 16 at a slightly lower velocity V2. As the flavor strip is conveyed to the cork drum, adhesive is applied to the top surface of the flavor strip by an applicator 18. The flavor strip is cut into unit length pieces 20 at the nip of the strip 14 and the drum 16 by any common cutting element, such as a reciprocating knife blade or knife drum 19, for example. The differential between V2 and V3 produces a predetermined spacing 24 between the cut pieces 20 of the flavor strip on the cork drum. The slower velocity V2 of the endless supply of flavor strip 14 and the slightly higher surface velocity of the cork drum uniquely produces the desired spacing 24. The spaced part cut pieces 20 then are glued in place on the traveling substrate 12, such as shown in FIG. 12. Glue 25 from applicator 26 also is applied along one edge 27 of the paper substrate. Vacuum 21 assists in holding the flavor film strips 20 to the cork drum and the paper substrate 12, as explained above.

The paper substrate 12 with glue 25 along edge 27 and with the flavor strips 20 in place then is conveyed through a garniture 28, where the paper substrate 12 is formed into an endless hollow tube 29 and where the opposite edge portions of the paper are glued together forming the longitudinal seam 106.

Figure 4:
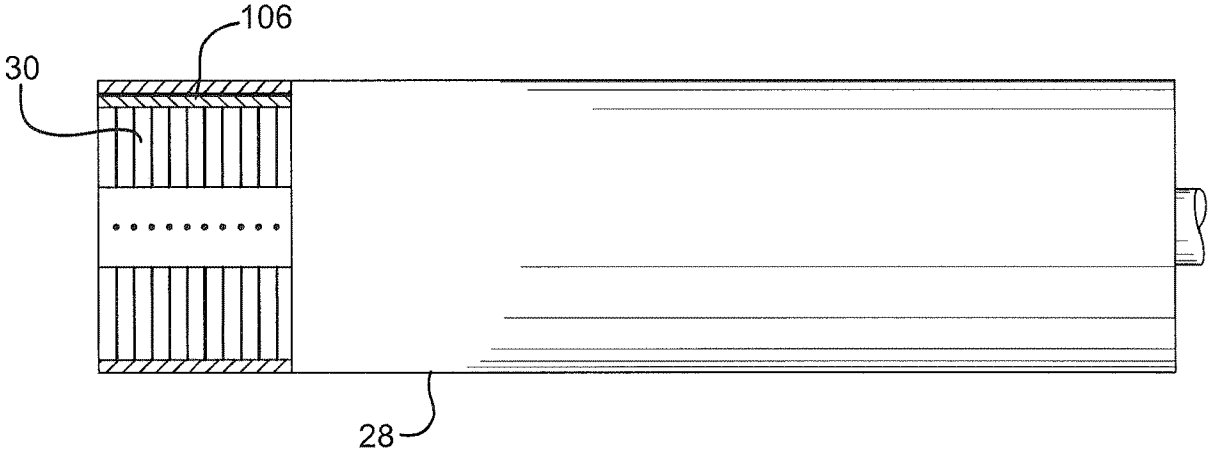
FIG. 4 is a side elevational view of the tube formation with portions thereof broken away to illustrate the brush within the tube.
Figure 4A:
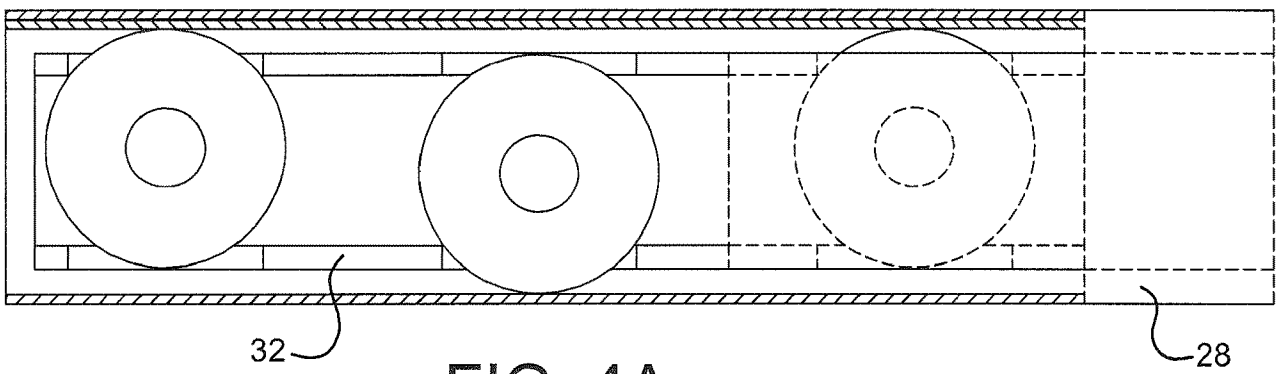
FIG. 4A is a view similar to FIG. 4 but illustrating the interior roller bar for maintaining the integrity of the paper tube.
Figure 3:
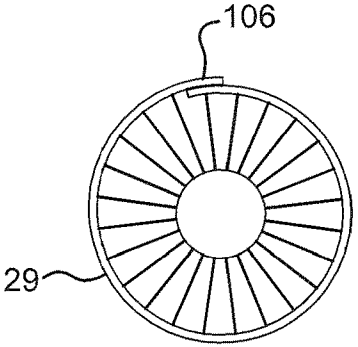
FIG. 3 is an end view illustrating formation of a hollow tube from a paper substrate with a structural brush inside the formed tube to maintain its structural integrity.
Figure 3A:
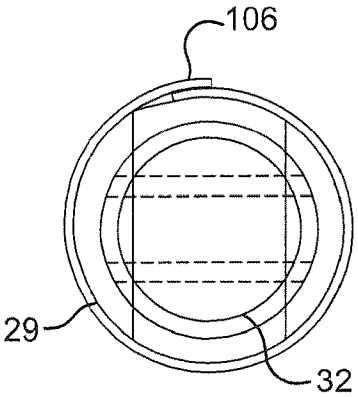
FIG. 3A is a similar view of FIG. 3, but illustrating an alternative interior roller bar in place of the brush, but serving the same function.

Several embodiments of the garniture 28 for tube formation may be utilized, including one that includes the interior brush 30 as shown in FIGS. 3 and 4, or the interior roller bar 32 as shown in FIG. 3A or 4A. Fundamentally, the paper substrate 12 with the spaced apart flavor film 20 thereon is drawn through the garniture 28 by an air permeable endless belt and rolled into a tubular form. Any suitable garniture structure may be utilized for that purpose, as described above. The interior brush 30 functions to hold and maintain the tube formed by the garniture and to assist in a tight longitudinal seam 106.

Similarly, as shown in FIGS. 3A and 4A, the interior roller bar 32 produces the same results of maintaining the tubular shape of the paper substrate. The rollers have a curved radius equal to that of the formed hollow tube 29, ensuring optimal tube formation. A vacuum plenum may be utilized in the garniture to assist in formation of the tube 29. When forming paper tubes solely from web (without the flavor film), the brush and/or rollers at the garniture counteract the tendency of the paper to collapse. Such expediencies are not needed when a flavor film is included, because the web and film structure has lesser tendency to collapse. Applying vacuum at one or more locations along the garniture is effective in facilitating folding action with the web and film structure, because of air impermeable nature of the flavor film.

In the embodiment illustrated in FIG. 1, a cutter 34 is positioned to cut the endless tube 29 into predetermined lengths 101. By way of example, each cut tube 101 may be of a length sufficient to form two pouches 100. Each length of the so-called 2-up tube then is transferred at the transfer section B to a series of mostly fluted drums 36, which cut, grade and align the tube 101 into one-up lengths 101', each for the formation of a single pouch 100. At first, the 2-up tube 101 is cut in half to produce two individual lengths 101', and then the lengths 101' are graded and aligned as described previously.

Figure 5:
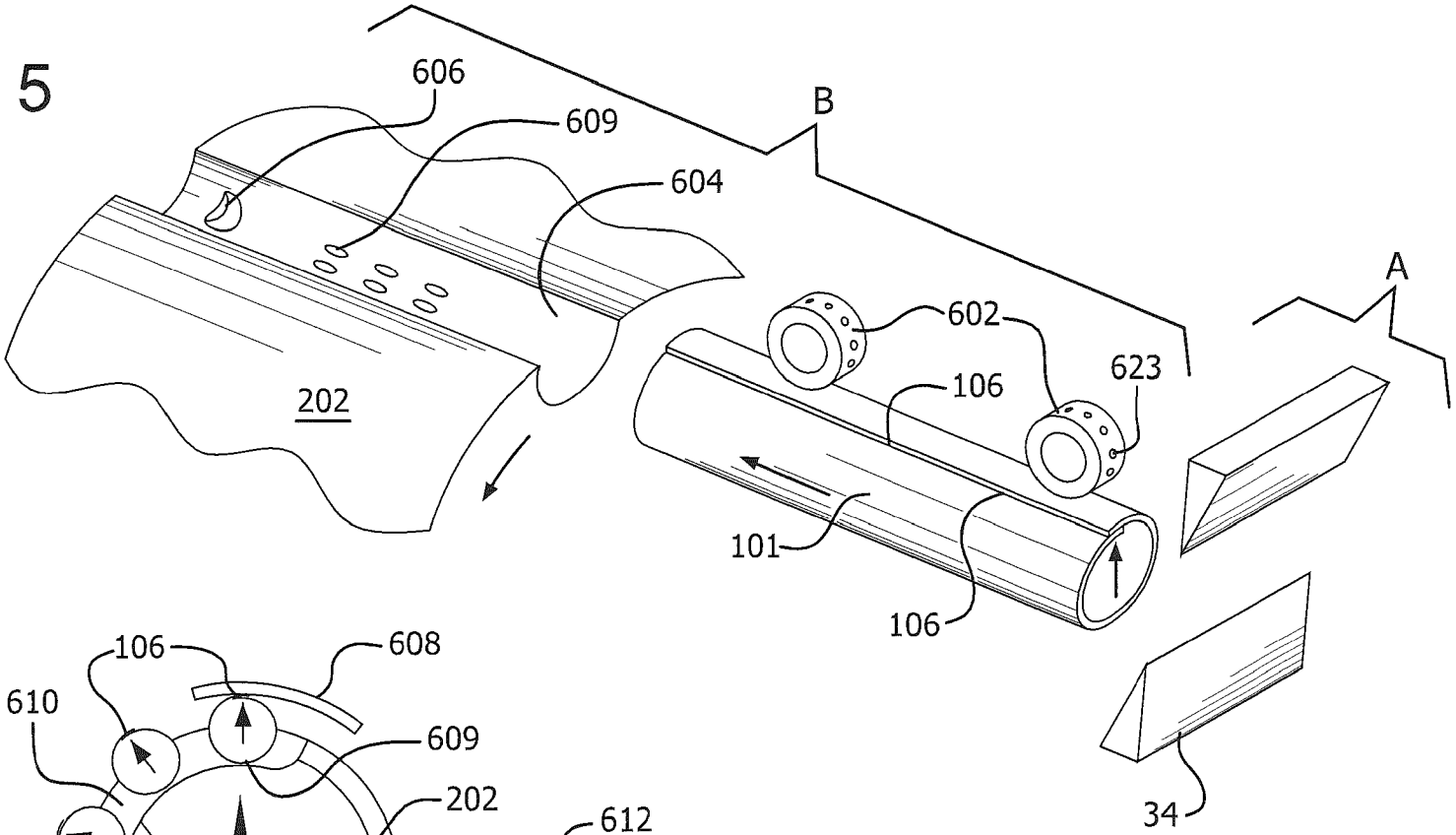
FIG. 5 is a detail, diagrammatic view illustrating in the embodiment of FIG. 1 transfer of the cut, tubular elements onto a first drum while maintaining desired seam orientation.
Figure 5A:
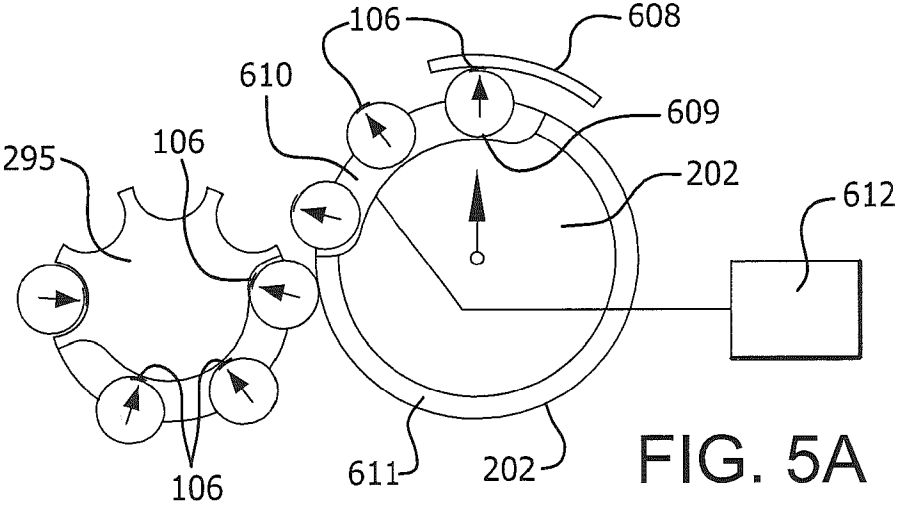
FIG. 5A is a further detail, end view of the transfer illustrated in FIG. 5.

Referring to FIGS. 1, 5 and 5A, the transfer of the cut tube 101 to the first drum 202 of the series of drums 36 in the embodiment of FIG. 1 preferably is executed with a catcher drum 202, which repetitively receives the output of the cutter 34 in a flute 604 as each flute 604 arrives at the 12 o'clock rotational position of the drum 202.

The catcher drum arrangement includes a stop 606, operative at each flute 604 to stop and register each tubular element 101 consistently along each of the flutes 604. Preferably, one or more vacuum assisted rotating rollers 602 help move the tubular elements into flutes 604. Preferably, vacuum ports 623 at spaced locations along the periphery of the roller or rollers 602 facilitate movement of the tubular element 101 into place. Preferably, once there, one or more vacuum ports 609 apply vacuum to retain the element 101 in the respective flute 604 with the desired orientation of the seam 106.

Referring also to FIG. 5A, the catcher drum may include a circumferential arcuate rail or canard 608 at the 12 o'clock position of the drum 202 to help guide the tubular element 101 into place. The drum 202 includes a fixed internal vacuum plenum 610, which extends circumferentially from the 12 o'clock position to the point of transfer to the next drum 295. Vacuum from vacuum source 612 is communicated through the vacuum ports 609 as the fluted rotational body 611 of drum 202 rotates.

Consistent placement of the tubular lengths 101 onto the first drum 202 is important in that the longitudinal seam 106 must be located at the bottom of one of the tube-receiving cavities on the outside of the drum 202 or, alternatively, in a 180° opposite relation to that location. This is necessary in order to ensure that crimping of the ends of the individual tube lengths occurs with the longitudinal seam at a preferred location midway between the side edges of the formed pouch, as shown in FIG. 11.

Figure 8:
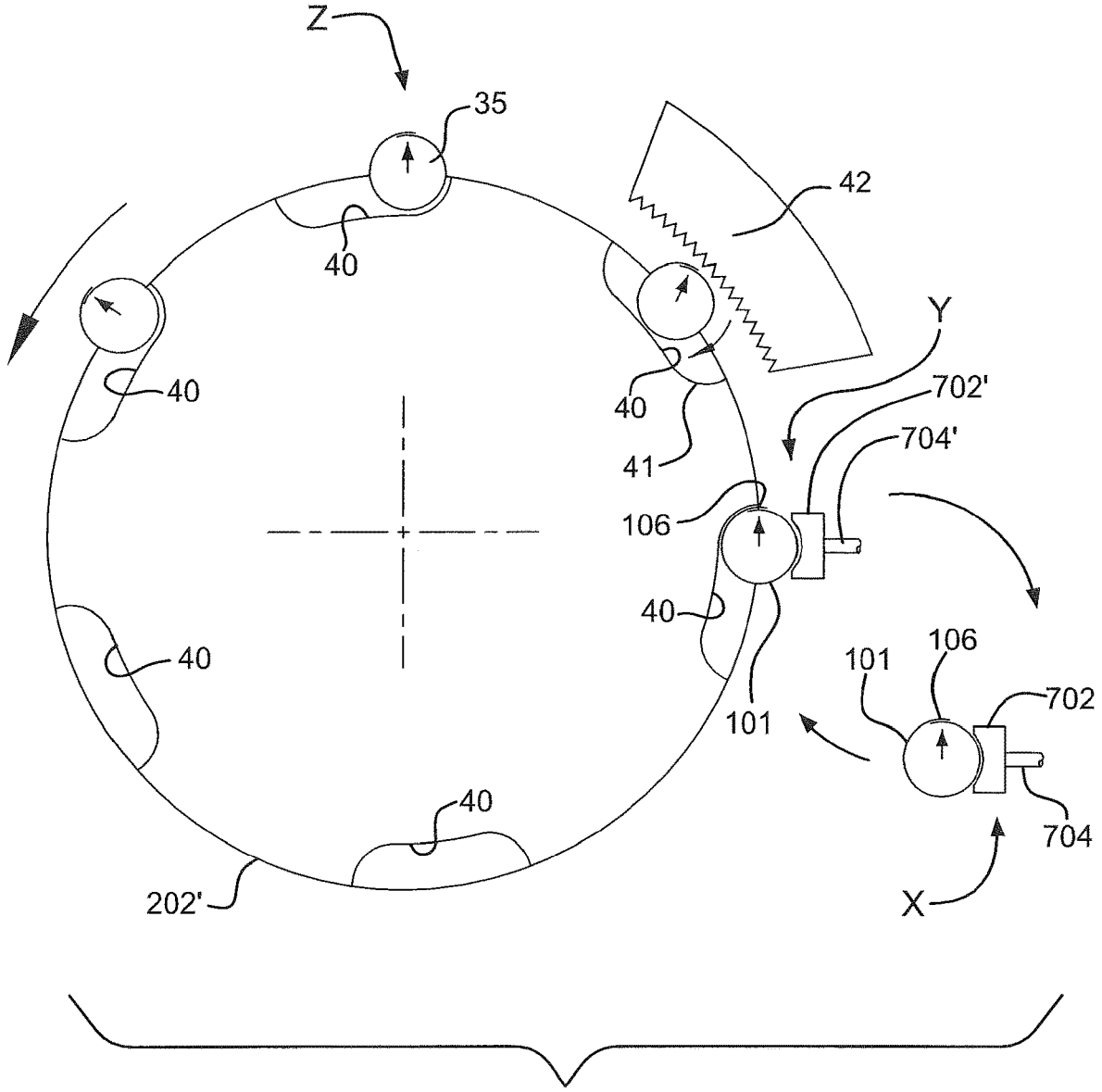
FIG. 8 is a diagrammatical end view illustrating transfer in the embodiment of FIG. 9 of the cut, tubular elements onto a first drum while achieving desired seam orientation.

Referring now to FIGS. 8 and 9, in an alternate embodiment of the machine 10 comprising machine 10', transfer of the multi-unit tubular elements 101 at section B' is executed using a Hauni Transfer Spider 92 such as a Hauni Protos SE 80 "Spider" (or other model having vacuum operated gripper bars 702 at the ends of armitures 704. The arms 704 are all rotatable via rotation of the Spider's disk 706, and each arm 704 is rotatable relative to the disk 706. The Spider is positioned downstream of section A' such that it picks up a tubular element 101 at the cutter 34 (as shown in FIG. 8 as designation X). When adjacent the cutter 34, the gripper 106 through application of a vacuum grips the tubular element 101 at its 3 o'clock position and moves to a delivery location adjacent the 3 o'clock position of the receiving drum 202' (which is at designation Y in FIG. 8), and then returns to the position x along an elliptical path. At the delivery location, vacuum is interrupted and the tubular element 101 is released and picked up by application of vacuum by the drum 202'. In this embodiment, the tubular element 101 is oriented with the seam 106 initially at an angle to the radius of the drum 202' instead of the desired alignment with the radius of the drum 202'.

To achieve the desired alignment, the drum 202' of this embodiment includes a circumferentially wide flute 40, which includes a "backstop" surface 41 and a roll-bar 42, which rolls the delivered tubular element 101 back against the backstop 41 such that the desired radical relation is achieved, such as shown at designation Z in FIG. 8. Although the Spider of section 8' is illustrated in canted relation to sections A' and C', it would be aligned with section A' such that the axis of rotation of the disk 706 of Spider is at a 90° relation to the axis of rotation of the drum 202'.

Use of the Hauni Protos SE 80 "Spider" is particularly beneficial in the production of pouches having an interior flavor film.

The multi-length tube 101 of FIG. 8 shows the longitudinal seam at the top of the tube and when transferred to the first drum 202. by vacuum transfer the position of the longitudinal seam is as shown. However, as the drum 202' rotates, the roller bar 42 engages the tubes 101 to rotate the tubes within the receiving cavities 40 on the outside of the drum 202'. The cavities are designed so as to allow rotation of the tubes 101 to an ultimate position, where the longitudinal seam is positioned on a radius of the drum 202' as shown.

At section C', the multiple length tubes 101 are cut, graded and aligned by the fluted drums at that section as described above. Ultimately a single tube 101' for production of a single pouch 100 is conveyed by beveled drum 46, which positions each individual tube 37 in a vertical orientation at the end of the path of travel from one fluted drum to the next at station C'.

As shown in FIGS. 1 and 13-15, in section D, D' each individual hollow tube 101' is placed on the outside (periphery) of the rotating processing wheel 48, having a vertical axis of rotation. As the tubes are placed on the wheel, the pair of crimping rollers 50, 52 at a fixed location directly below the processing wheel 48 function to crimp and thereby sealingly close the lower end of each tube. Each crimping roller 50, 52 preferably has a vertical axis of rotation, and both axes are positioned along a radius of the processing wheel 48. With the longitudinal seam 106 positioned as explained above, the lower transverse seam 102 thereby is formed with the longitudinal seam 106 positioned midway between the sides of the pouch 100 being formed, and with the transverse seam 102 in orthogonal relation to the longitudinal seam 106.

After the closing of the lower end of the tube 101', continued rotation of the processing wheel 48 conveys the tubes to filling station, where tobacco 56 or other content is fed into the tubes. The hopper 58 and vibratory pan feeder 60 at the filling station function to perform the tobacco filling operation. The feed rate may be controlled by varying the vibration and the depth of tobacco 56 on the vibrating pan 60.

Referring now to FIGS. 14-18, the processing wheel 48 has a series of funnel like pockets 62 around the perimeter of the wheel. The top of each pocket 62 has the shape of a truncated circular sector, and the bottom of each pocket is a round hole 64. The hole in each pocket preferably is located directly above the open end of a tube 101'. The walls of the pockets 62 are oriented to facilitate flow of the tobacco 56 into the tubes 101'. The bottom of the pocket 62 may include an extension 66 that fits inside the open end of the tube 101'. The inner and outer walls of the pocket may extend to form a trough to capture the discharge of the vibratory pan feeder 60. The walls 68 between adjacent pockets 62 form a sharp edge such that all of the tobacco or other content that falls into the pockets flows through the pockets into the tubes 101'. The discharge may be vertical or may be inclined.

As each pocket 62 moves through the "waterfall" of tobacco 56 or other content being delivered by vibratory pan feeder 60, the tobacco is funneled through the pocket into the tube 101' positioned below the bottom opening 64, 66 of each pocket. Since the tobacco flow is consistent in both flow and discharge shape, and each pocket 62 of the processing wheel 48 is identical in size and shape, and the rate of rotation of the wheel is constant, the amount of tobacco captured by each pocket 62 is consistent. As a result, the amount of tobacco 56 or other content loaded into each tube 101' is Consistent. Also, the sizing of the various components and the tobacco flow rate is such that all of the tobacco is delivered from the pockets to the tubes 101' in less than a full revolution of the processing wheel 48, and the remainder of the revolution may be used for crimp-closing the tubes, inspection, as noted above, and rejection of pouches out of specification, other quality control measures, unloading the pouches 100 and loading empty tubes 101' onto the processing wheel 48.

The second pair of crimping rollers 70, 72 are at a fixed location and spaced above the processing wheel 48 for crimp-closing and sealing the top of each tube 101' to form the upper, second transverse seam 104. Similar to the first pair of crimping rollers 50, 52, preferably the vertical axes of each of the second crimping rollers is positioned along the radius of the processing wheel 48 to thereby ensure that the upper transverse seam 104 is parallel to the lower transverse seam 102, and that the longitudinal seam 106 is midway between the sides of the finished pouch 100, and that the upper transverse seam is in the desired orthogonal relation to the longitudinal seam 106. The crimping rollers may be heated to enhance sealing along the transverse seams of the tubes 101'. Also, adhesive may be applied to the inside open edges of the tube to enhance closure, if desired. These features may also be used to form the lower crimp, as well.

The formed pouches 100 then may be removed from the processing wheel 48, inspected for quality control, as explained above, and packaged for transport. Each finished pouch 100 preferably contains tobacco 56 and, optionally, a dissolvable flavor film 20.

Figure 6:
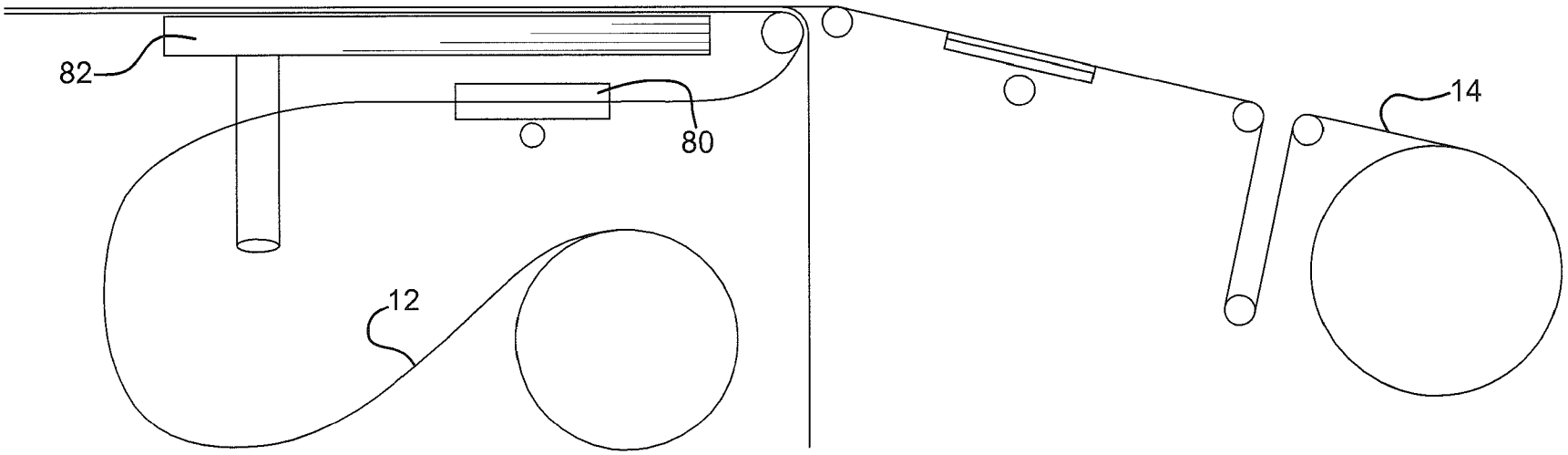
FIG. 6 is an alternate embodiment illustrating a continuous flavor strip applied to a continuous paper substrate without the strip being cut into pieces.
Figure 7:
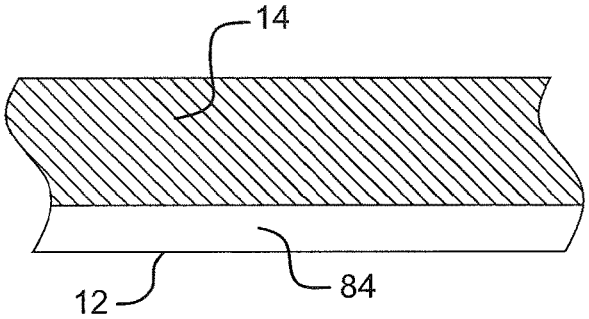
FIG. 7 is a top plan view of the continuous paper substrate with a continuous flavor film or strip thereon as formed in FIG. 6.

FIGS. 6 and 7 diagrammatically illustrate another embodiment of the present invention, where the endless flavor film 14 is disposed along a continuous paper substrate 12 without the flavor strip being cut into individual pieces, such as shown in FIG. 10. Optionally, adhesive is applied to the top of the paper substrate by an applicator 80, and the endless flavor film 14 then is glued in place on the paper substrate, with vacuum being applied via chamber 82 as the substrate and flavor strip move in a downstream direction. Preferably, the ribbon of paper 12 has a width greater than that of the ribbon of flavor film 14, and the paper and flavor film ribbons mutually are arranged so that the longitudinal edge 84 of the paper substrate 12 is without flavor film to facilitate formation of the longitudinal seam 106 as the paper strip is rolled into tubular form by the garniture 28, as described above. The garniture is used to form the tube, and any known garniture or other folding apparatus may be used for that purpose, such as those described above or others well known in the art. Once the tube is formed, the remaining downstream operations to final pouch formation may be similar to those described above in connection with the poucher 10,10' of FIGS. 1 and 9.

It is to be realized that any embodiment may be modified to produce tubes equal in length of individual pouches so as to avoid the need for cutting, grading and alignment of tube pieces at section C, C'. Otherwise, the sections are similar to those described above.

It also is envisioned that the aforementioned section A, A' may be configured to form multi-unit tubular elements 101" from a tubular extrusion process or the like, wherein a cellulosic slurry or other suitable material is extruded through a die and then Cut. In such case, there may be an absence of a longitudinal seam in the tubular element 101'.

The crimping and material filling section preferably comprises a series of drums or wheels to facilitate execution of its functionalities. It is possible to conduct its crimping, filling, closing and, optionally, inspection functionalities at locations along a linear fashion instead of along rotating drums or wheels. Likewise for the section C, C'.

The flavor film 14, whether in pieces 20 or continuous, also functions as an interior liner, which reduces the tendency of the tobacco 56 or other content to discolor (stain) the paper 12 by reducing the opportunity for moisture from the tobacco or its additives, if any, to reach the paper prior to use. The flavor film 14 also allows the moisture content and other properties of the tobacco to be maintained in its original (fresh) condition until actual use.

Variations and modifications of the foregoing will be apparent to those skilled in the art. Such variations and modifications are to be considered within the purview and scope of the claims appended hereto.

What is claimed is:

1. An apparatus for forming a plurality of oral pouch products, the apparatus comprising:

a wheel configured to continuously rotate about a first axis of rotation, the wheel including, an outer surface configured to receive a plurality of tubes;

a first pair of crimping rollers on a first side of the wheel, the first pair of crimping rollers configured to rotate about respective second axes parallel to the first axis, and to sequentially create a first transverse seam on each of the plurality of tubes to form a respective plurality of open-ended pouches;

a material feeder configured to deposit a material into each of the plurality of open-ended pouches; and a second pair of crimping rollers on a second side of the wheel opposite the first side of the wheel, the second pair of crimping rollers configured to rotate about respective third axes parallel to the first axis, and to sequentially create a second transverse seam on each of the plurality of open-ended pouches to form a respective plurality of oral pouch products.

2. The apparatus of claim 1, wherein the outer surface of the wheel defines a plurality of flutes, and each of the plurality of flutes is configured to receive a respective one of the plurality of tubes.

3. The apparatus of claim 2, wherein the plurality of tubes is configured to be retained in the respective plurality of flutes by application of vacuum.

4. The apparatus of claim 1, wherein the material feeder includes a vibratory pan feeder on the second side of the wheel.

5. The apparatus of claim 1, wherein the wheel further defines a plurality of pockets, each of the plurality of pockets configured to be aligned with a respective one of the plurality of tubes.

6. The apparatus of claim 5, wherein the wheel further comprises a plurality of walls, and each of the plurality of walls is between two of the plurality of pockets.

7. The apparatus of claim 6, wherein each of the plurality of walls defines a sharp edge configured to facilitate movement of the material into one of the plurality of pockets.

8. The apparatus of claim 5, wherein the wheel further comprises a plurality of extensions, each of the plurality of extensions is associated with a respective one of the plurality of pockets, and each of the plurality of extensions is configured to be at least partially inside of a respective one of the plurality of open-ended pouches.

9. The apparatus of claim 1, wherein the first axis, the second axes, and the third axes are vertical, the first side is a bottom side, and the second side is a top side.

10. The apparatus of claim 1, further comprising:

a rejection station between the material feeder and the second pair of crimping rollers.

11. The apparatus of claim 10, further comprising:

a sensor configured to generate a signal indicative of a level of material in each of the open-ended pouches.

12. The apparatus of claim 1, further comprising:

a series of transfer drums configured to receive a plurality of first tubes and cut each of the plurality of first tubes into a plurality of second tubes, the plurality of second tubes being the plurality of tubes.

13. The apparatus of claim 12, wherein the series of transfer drums comprises:

a severing drum configured to separate each of the plurality of first tubes into the plurality of second tubes.

14. The apparatus of claim 13, wherein the series of transfer drums further comprises:

a beveled transfer drum configured to change an orientation of each of the plurality of second tubes.

15. The apparatus of claim 14, wherein the series of transfer drums further comprises:

a grading drum; and an aligning drum.

16. The apparatus of claim 12, further comprising:

a transfer section configured to provide the plurality of first tubes to the series of transfer drums, the transfer section including, a rotatable disk, a plurality of arms coupled to the rotatable disk, and a plurality of gripper bars, each of the plurality of gripper bars associated with a respective one of the plurality of arms, wherein the transfer section is configured to receive, sequentially, a plurality of first tubes.

17. The apparatus of claim 16, wherein the plurality of gripper bars is a plurality of vacuum-operated gripper bars.

18. The apparatus of claim 16, further comprising:

a cutter configured to cut a hollow, endless tube into the first tubes, wherein the transfer section is configured to receive the first tubes from the cutter.

19. The apparatus of claim 18, further comprising:

a garniture configured to form a web into the hollow, endless tube, the hollow, endless tube having overlapping edge portions.

20. The apparatus of claim 1, wherein the apparatus of configured to produce pouches at a rate ranging from 1,300 pouches per minute to 1,700 pouches per minute.

* * * * *